US006027283A

United States Patent [19]

Schweinberg et al.

[11] Patent Number: 6,027,283

[45] Date of Patent: Feb. 22, 2000

[54] END CAPS FOR DRAINAGE SYSTEM

[75] Inventors: F. Matthew Schweinberg, Knoxville; Julie F. Frye, Maryville; Jeff S. Zager, Friendsville, all of Tenn.

[73] Assignee: Strongwell Corporation, Bristol, Va.

[21] Appl. No.: 09/107,498

[22] Filed: Jun. 30, 1998

[51] Int. Cl.[7] ..... E02B 13/02

[52] U.S. Cl. ..... 405/42; 405/118; 404/4

[58] Field of Search ..... 405/42, 118, 119, 405/120, 121, 122, 123; 404/2, 4

[56] References Cited

U.S. PATENT DOCUMENTS

| | | | |
|---|---|---|---|
| 1,062,778 | 5/1913 | Hedrick . | |
| 4,142,370 | 3/1979 | Giordano | 405/119 |
| 5,501,547 | 3/1996 | Mantelli | 405/121 |
| 5,529,436 | 6/1996 | Meyers | 405/119 |
| 5,645,367 | 7/1997 | Gunter | 404/3 |

OTHER PUBLICATIONS

Brochure, Quazite, A division of MMFG, Polycast® Presloped Surface Drain System, face. back page and 24 informational pages, 1995.

*Primary Examiner*—David Bagnell
*Assistant Examiner*—Frederick Lagman
*Attorney, Agent, or Firm*—Moore & Van Allen, PLLC; Michael G. Johnston

[57] ABSTRACT

An end cap for a drainage system comprises a wall element having substantially the same profile as the cross-section of the end of the trench drain channel section. The wall element is adapted to be coupled to the trench drain channel section to form a terminal end of the channel section. At least one transverse groove is provided in the channel section so that, when the end cap is separated at the groove, the height of the end cap corresponds to the depth of the channel section. Typically, a plurality of transverse grooves are provided at spaced intervals along the vertical height of the wall element which correspond to different possible depths of the channel section. Thus, the end cap may be adapted to fit any one of a number of channel sections, regardless of depth. The end cap may further comprise a pipe coupler integrally molded with the wall element such that the wall element and coupler are substantially continuous. The pipe coupler extends outwardly from the wall element and defines an aperture having a predetermined shape and size for receiving a pipe, such that the pipe and at least a portion of the coupler are in fluid communication.

16 Claims, 8 Drawing Sheets

END CAPS FOR DRAINAGE SYSTEM

CROSS-REFERENCES none

GOVERNMENT RIGHTS none

BACKGROUND

This invention relates generally to drainage systems for water or other liquids, and more particularly concerns a component for a trench drain system for capping the open ends of the trench drain channels.

Drainage systems which include trenches are used in numerous industrial and municipal applications where there is a need to drain a generally flat surface. For example, industrial settings sometimes require drainage systems formed in building floors to collect and remove excess water or other liquids. Outdoor industrial and commercial sites, such as airports, large parking lots, roadway medians, service station aprons, driveways and the like, require drainage systems to collect and direct rainwater and other liquids to prevent flooding and to decrease runoff.

Trench drain systems are usually constructed by placing and securing a number of premade channel sections in a ditch which has previously been formed in the ground. The channel sections are installed flush to grade or finish surface. Typically, the channel sections are precast from a material which is selected based upon the load requirements and the type of liquids which the system is designed to transport. The channel section can be formed of a variety of cementitious, polymeric or metal materials. In one type of trench drain system, the channel sections are formed of a combination of polymeric resin and aggregate material, referred to as polymer concrete.

The channel sections may be designed with a predetermined slope to facilitate fluid flow or with no slope. Each of the sloped channel sections has an upstream depth and downstream depth specific to that channel section. Channel sections having no slope are commonly referred to as neutral channels. Once the channel sections are positioned in the ditch, a cement-based material, usually concrete, is poured around the channel sections and allowed to set.

Drainage systems may be assembled in any number of configurations having turns, intersections and other transitions. The systems can also include a number of other components such as transition pieces, liquid collection basins, trash baskets, and the like, which are connected to the channel sections to provide drain run transitions, liquid collection points, and for the removal of solid debris. Since the various components of a drainage system can be spaced apart in the field, the system components are interconnected by pipes connected to outlets formed in the walls of the system components.

Another component of a trench drain system is an end cap. The end cap fits against the open end of the channel section. The inner wall surface of the end cap contacts the end of the channel section and is adapted to fit closely against the channel section end. A sealant can be used in the seam between the end cap and the end of the channel section to help prevent leakage.

There are two types of end caps: a terminal end cap and a drain end cap. The terminal end cap is a generally flat piece which is used to completely close off the open end of the channel section.

The drain end cap includes an outlet in which a short pipe extension is installed so that at least a portion of the pipe extension protrudes outwardly from the wall of the end cap for connection to a pipe. For example, a PVC pipe extension can be at least partially embedded or cast within a polymer concrete end cap during formation or molding of the end cap. Alternatively, the pipe extension can be installed in the end cap in the field, which requires that an appropriately-sized hole be formed in the end cap to receive at least a portion of the pipe extension. Pre-formed cut-outs in the end cap which must be drilled and chiseled out are sometimes provided for this purpose. The pipe extension is then secured in the hole with an adhesive. The drain end cap is used where pipe connections or other transitions are necessary, such as when bottom draining of the trench unit is not possible due to lack of available space. A pipe fitting, such as a coupler, is used to attach the pipe extension to the pipe.

A common problem with the use of trench drain systems is that many different size end caps are needed to accommodate varying channel section depths. This is particularly true when sloped channel sections are used since the depth of the channel section presented for capping will depend on the length of the trench drain run. Thus, the number of end caps which must be manufactured and sold are quite large, and the selection of the appropriately-sized end caps to match the channel section ends can be difficult.

Further, the use of drain end caps has been found to be a disadvantage for several reasons. In particular, manufacturing the drain end caps is problematic due to the difficulty of establishing a bond between the end cap and pipe extension, which is usually PVC. Because of the difficulty of getting a good chemical bond between the polyester resin and the PVC pipe, sometimes a groove is cut in the pipe extension prior to placing the piece in the mold and casting around the extension to help establish a mechanical bond.

If the pipe extension is installed in the field, a hole of relatively precise dimensions must be formed in the end cap in order to properly receive the pipe extension. Even where cut-outs are available, one must carefully drill and chisel the end cap to remove the cut-out. However, the materials which form the drainage system components are relatively brittle, especially as the percentage by weight of aggregate material increases. Thus, all or part of the end cap could shatter during formation of the hole.

Storage and transportation of the drain end caps can also be difficult and awkward since the pipe extension increases the fragility of the structure. During transportation and storage, the pipe extension can be bumped or otherwise impacted possibly fracturing the pipe extension, the end cap, or both.

Regardless of which installation method is used, a pipe fitting must generally be employed to secure the pipe to the outwardly extending portion of the pipe extension. Thus, use of the pipe extension to couple the end cap to the pipe increases the number of components required to assemble the drainage system and the resulting cost of the drainage system. Moreover, an additional joint is formed which may leak.

For the foregoing reasons, there is a need for an end cap component of a drainage system which can accommodate channel sections of different depths thereby reducing the number of end caps needed for a drainage system. Where a drain end cap is required, the end cap should include a pipe extension which is made so as to be nearly unbreakable. The pipe extension should be sized to serve as a standard pipe fitting thus eliminating the number of components necessary for assembling the drainage system. Preferably, the end cap would be easy to manufacture and install.

SUMMARY

The present invention is directed to a device that satisfies these needs. An end cap for a drainage system having features of the present invention comprises a wall element having substantially the same profile as the cross-section of the end of the trench drain channel section. The wall element is adapted to be coupled to the trench drain channel section to form a terminal end of the channel section. At least one transverse groove is provided in the channel section so that, when the end cap is separated at the groove, the height of the end cap corresponds to the depth of the channel section. According to the invention, the end cap may comprise a plurality of the transverse grooves provided at spaced intervals along the vertical height of the wall element and which correspond to different possible depths of the channel section. Thus, the end cap may be adapted to fit any one of a number of channel sections, regardless of depth.

The present invention overcomes the drawbacks of conventional drain end caps by providing an end cap of the above construction and further comprising a conduit coupler integrally molded with the wall element such that the wall element and coupler are substantially continuous. The conduit coupler extends outwardly from the wall element and defines an aperture having a predetermined shape and size for receiving a conduit, such that the conduit and at least a portion of the coupler are in fluid communication.

Accordingly, it is an object of the present invention to provide a new end cap for trench drain systems having one or more of the novel features of this invention as set forth above or hereinafter shown or described.

It is also an object of the present invention to provide a universal end cap which can be readily installed on a standard channel section end and which can be adapted to accommodate any desired depth of the channel section. A related object of the present invention is to provide an end cap which can be easily and quickly sized to fit and installed on the channel section without requiring any special means.

A further object of the present invention is to provide an end cap component of a trench drain system having a pipe extension which allows the drain end cap to be handled, stored and transported while reducing the possibility of damage to the component. Still a further object of the present invention is to provide a pipe extension as part of an end cap component which is resistant to damage during installation of the end cap in the field. Another object of the present invention is to provide a drain end cap for a trench drain system which allows pipe to be readily connected to the end cap without using additional pipe fittings.

Finally, an object of the present invention is to provide an end cap that is economical to manufacture and easy to install. The resulting object of the present invention is an economical component of an overall trench drain system which reduces the need to stock numerous, different size end caps.

A principal feature of the present invention is that the end cap can be shortened to predetermined heights to match the depth of the end of the channel section. A plurality of transverse, horizontal grooves are positioned at predetermined points along the height of the end cap so the end cap can be easily broken off or cut to a desired height prior to installation. The end caps are adapted to be connectable to either end of the trench drain channel section. The drain end cap of the present invention is formed of a single piece, preferably injection molded plastic, so that the wall of the end cap and pipe extension are substantially continuous. This construction provides a strong, nearly unbreakable unit. The pipe extension is a predetermined size and shape which corresponds to the size and shape of standard pipe so the pipe can be frictionally engaged by or glued to the pipe extension.

The present invention overcomes the drawbacks of conventional trench drain end caps by providing a universal end cap capable of sealing the ends of the trench drain channel sections regardless of depth. All necessary features for the end caps are molded into the end cap of the present invention. The possibility of damaging the molded, single piece drain end cap during transportation and storage is greatly minimized. Moreover, since the pipe extension, or "coupler", is integral with the end cap, the end cap need not be modified in the field to receive the pipe coupler. Further, the drain end cap allows attachment of pipe thereto without a pipe fitting, thereby reducing the number of joints and overall cost of the drainage system. In addition, the reliability of the drainage system is enhanced since the coupling to the pipe coupler does not create another joint. The end cap of the present invention eliminates the need to manufacture numerous end cap units for each particular channel section depth. Manufacturing and inventory costs associated with requiring many different end caps are reduced.

BRIEF DESCRIPTION OF THE DRAWINGS

For a more complete understanding of this invention reference should now be had to the embodiments illustrated in greater detail in the accompanying drawings. In the drawings.

DESCRIPTION

Figure 1:
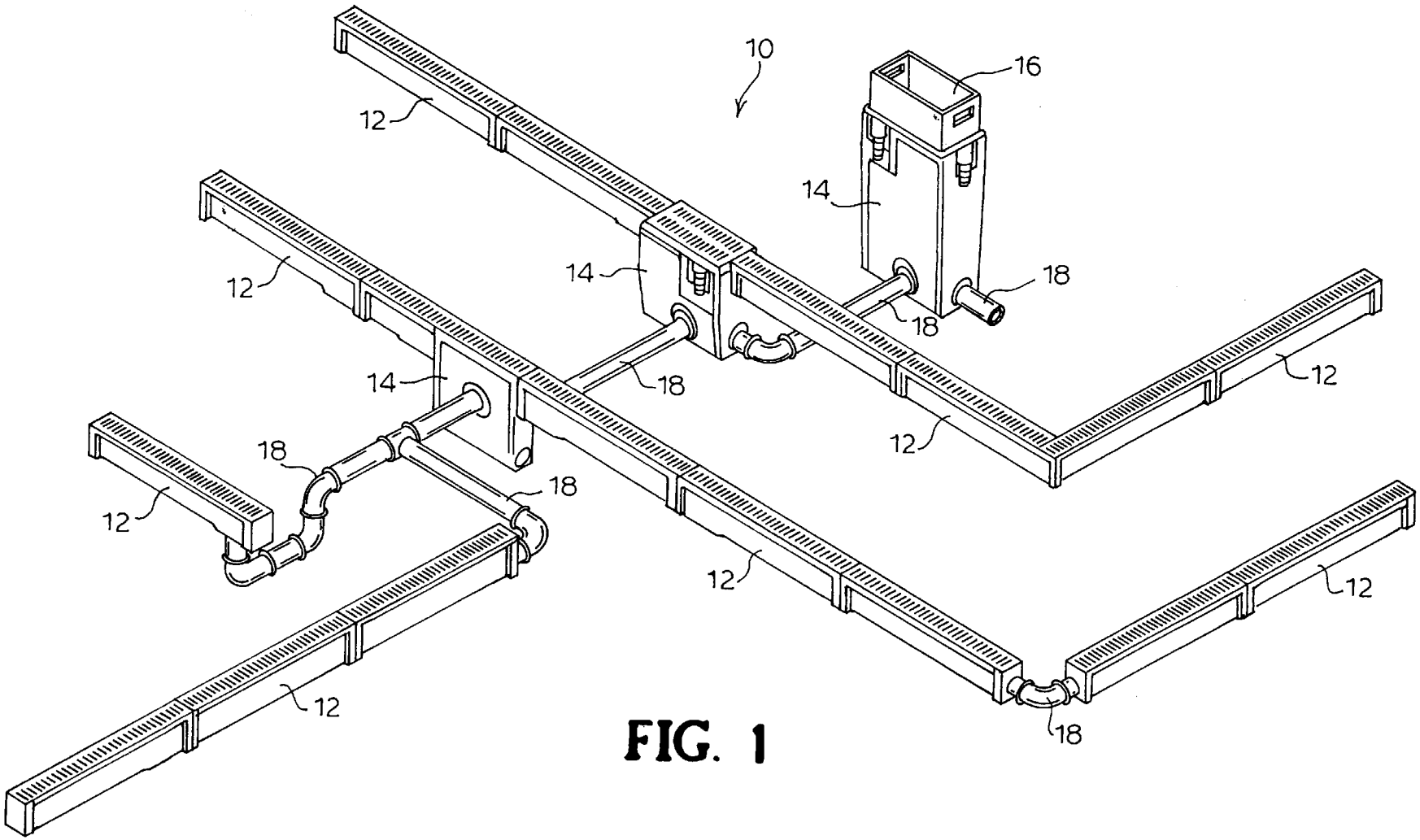
FIG. 1 is a perspective view of an exemplary trench drain system.

Referring now to FIG. 1, a conventional drainage system is shown, generally designated at 10. The drainage system includes trench drains 12, catch basins 14, a trash basket 16 and runs of pipe 18 interconnecting the drainage system components. Liquid conveyed by the trench drains 12 flows directly to one of the catch basins 14, or reaches the catch basins 14 through the pipes 18. The smaller catch basins 14 are drained via pipe 18 to the larger catch basins 14. The drainage system serves to collect and channel liquids from the surrounding surfaces and then to a sewer, a treatment facility, a sanitary drain, reservoir, lake, river or the like (not shown). It is understood that the embodiment of the drainage system illustrated and described herein is exemplary, and other types of drainage systems or other types of liquid collection components known to those skilled in the art may be used without departing from the spirit and scope of the present invention.

Figure 2:
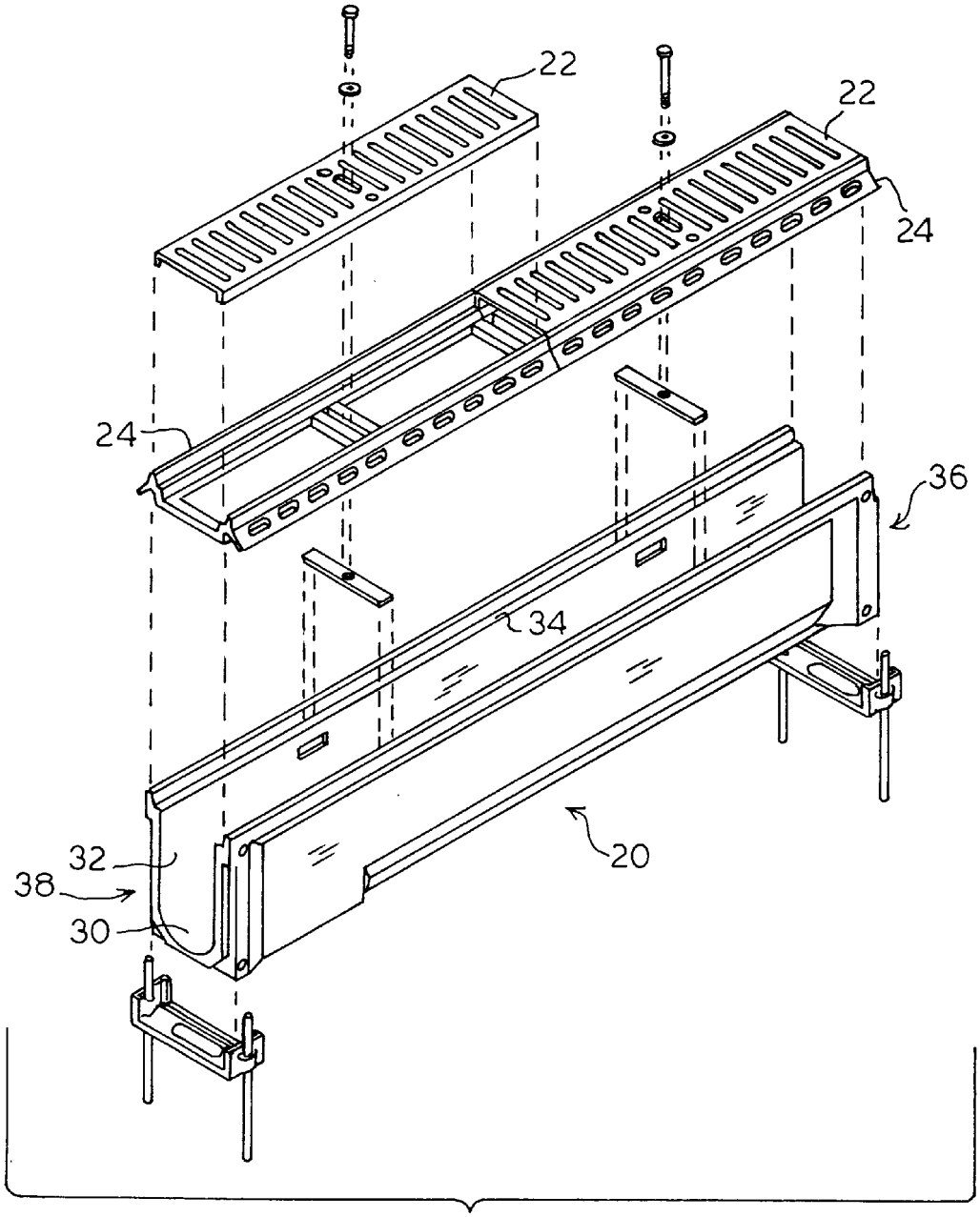
FIG. 2 is an exploded view of a portion of the trench drain system shown in FIG. 1.

FIG. 2 shows a portion of the trench drain 12. The trench drain 12 comprises standard length, generally U-shaped open topped channel sections 20, a covering grate 22 and an optional grate frame 24. The channel section 20 may be sloped or neutral. The channel section 20 includes a bottom wall 30 and opposed, vertically-aligned side walls 32 which extend upwardly from opposite sides of the bottom wall 30. The side walls 32 include bearing ledges 34 for receiving the covering grate 22 or grate frame 24 and grate 22. The grate 22 defines a number of openings through which liquid is collected within the channel section 20. The optional grate frames 24 are used for strengthening the bearing ledges 34 of the channel sections 20 to improve the load and impact performance and protect the walls 32 of the channel section 20.

Figure 3A:
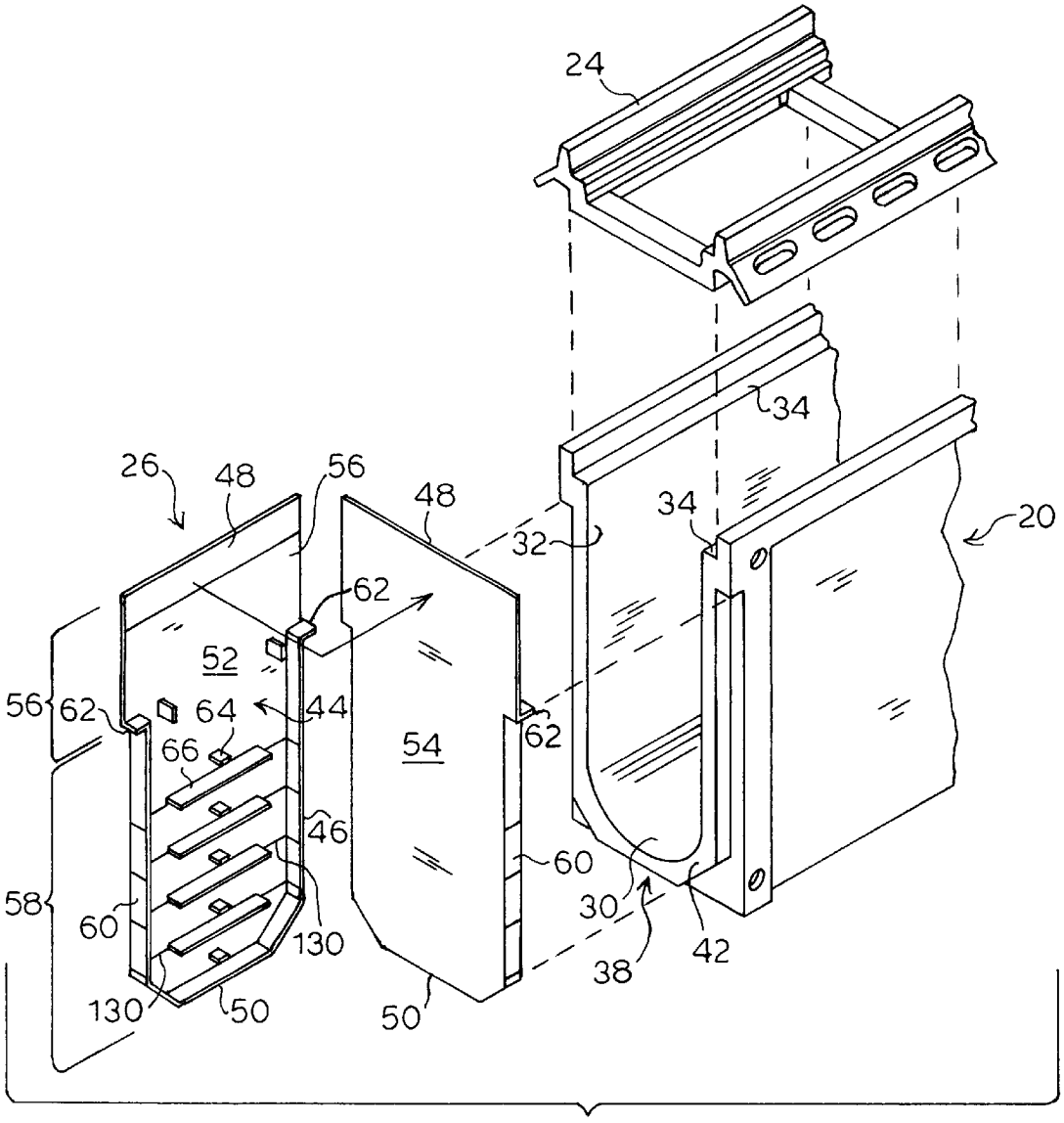
FIG. 3A is an exploded view of a portion of a male end of a channel section and a grate frame and showing an embodiment of a female terminal end cap according to the present invention.

The trench drains 12 are formed by interlocking the ends of the channel sections 20. For this purpose, each of the channel sections has a male end 38 and a female end 36. As seen in FIG. 3A, the male end 38 of the channel section 20 comprises a flange 42 extending substantially normally from, but spaced inwardly of the outer surfaces of, the bottom wall 30 and side walls 32 of the channel section 20. The female end 36 (FIG. 4A) also includes a flange 40 extending substantially normally from the periphery of the bottom wall 30 and side walls 32 of the channel section 20. It is apparent from FIGS. 3A and 4A that the flange 40 at the female end 36 of the channel section 20 defines a pocket having the same profile as the flange 42 at the male end 38. Thus, the corresponding female and male ends 36, 38 of successive channel sections 20 fit snugly together so as to provide a substantially sealing engagement. To ensure liquid-tight contact, the seam may be filled with a sealant.

Figure 4B:
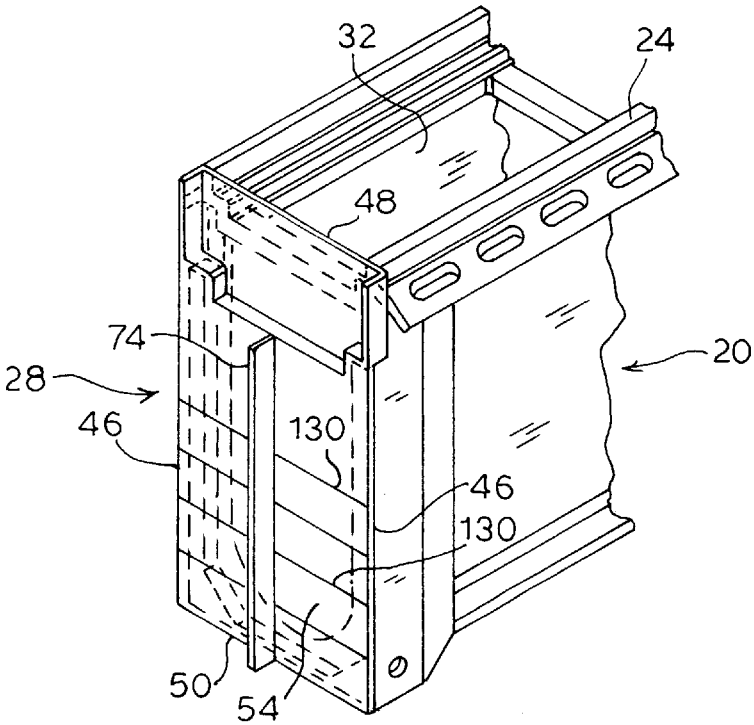
FIG. 4B is a perspective view of FIG. 4A showing the terminal end cap in place on the end of the channel section.
Figure 4A:
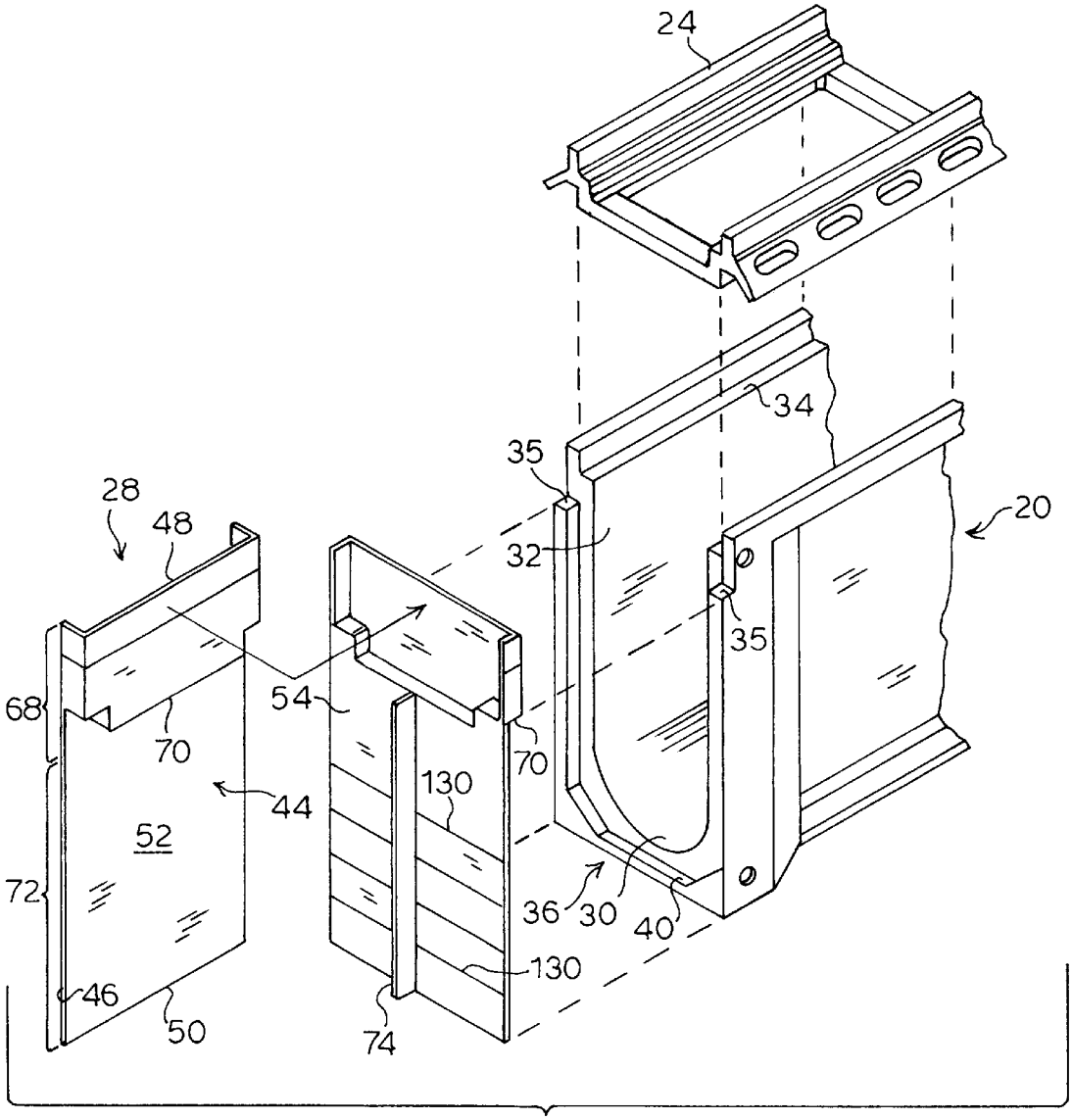
FIG. 4A is an exploded view of a portion of a female end of a channel section and a grate frame and showing an embodiment of a male terminal end cap according to the present invention.

The end caps 26, 28 shown in FIGS. 3A and 4A are terminal end caps for closing off the ends of the channel section 20 according to the present invention. The end caps 26, 28 preferably correspond in size and shape to the end of the channel section 20. Each end cap 26, 28 includes a wall 44 having side 46, top 48 and bottom 50 peripheral edge surfaces. The wall 44 has an inner surface 52 which, in use, faces the interior of channel section 20, and an opposed outer wall surface 54 positioned exterior to the channel section 20. It is understood that the embodiment of the end caps illustrated and described herein are exemplary, and other types of end caps corresponding to different shapes and sizes of drainage systems known to those skilled in the art may be used without departing from the spirit and scope of the present invention.

Preferably, the end caps of the present invention are injection molded from a suitable plastic such as, for example, high density polyethylene. However, the end caps may be molded out of any flexible resilient materials, including polyvinylchloride, polyethylene, polypropylene, rubber, and the like. Polyester resin is preferred for normal environments and vinyl ester resin is used in high temperature or corrosive environments. The scope of the invention is not intended to be limited by the materials listed here, but may be carried out using any material which allows the manufacture and use of the end caps as described herein.

Figure 3B:
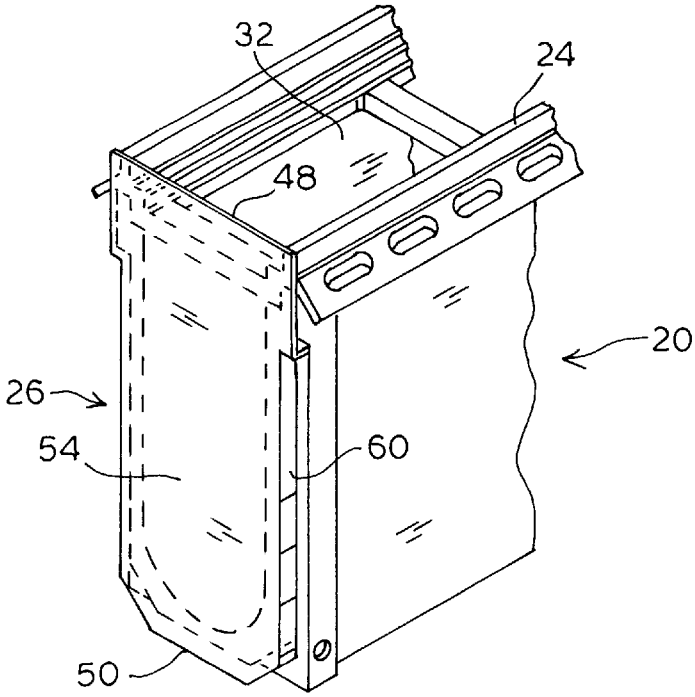
FIG. 3B is a perspective view of FIG. 3A showing the terminal end cap in place on the end of the channel section.

The terminal end caps 26, 28 are adapted to be coupled to the respective female end 36 and male end 38 of the channel section 20. Specifically referring to FIGS. 3A and 3B, the female end cap 26 is adapted to sealably engage the male end 38 of the channel section 20. As best seen in FIG. 3A, the top portion 56 of the female end cap 26 is the full width of the channel section 20. The lower portion 58 of the female end cap 26 is narrower than the top portion 56. The lower portion 58 includes a flange 60 extending substantially normally inwardly from the peripheral edge surfaces of the sides 46 and bottom wall 50 of the end cap 26. The flange 60 defines opposed horizontal shoulders 62 at the point where the top portion 56 and lower portion 58 of the end cap 26 meet.

The inner wall surface 52 of the end cap 26 includes spaced, alternating horizontal tabs 64 and ribs 66. The portion of the flange 42 extending from the male end 38 of the channel section 20 fits between a selected tab 64 and rib 66, depending on the depth of the channel section 20, such that the tab 64 rests on the inside of the bottom wall 30 of the channel section 20 and the rib 66 engages the outside bottom of the flange 42. This configuration thereby allows the female end cap 26 to tightly engage the male end 38 of the channel section 20. However, while a certain configuration for mating the end caps to the channel sections is shown, it is understood that any interrelating connection is contemplated.

The male end cap 28 shown in FIGS. 4A and 4B closes off the female end 36 of the channel section 20. The male end cap 28 is the full width of the channel section 20 and includes an upper portion 68 and a lower 72 portion. An upper portion 68 of the inner wall surface 52 of the end cap 28 protrudes inwardly forming a ledge 70. The male end cap 28 slips onto the female end 36 of the channel section 20 such that the ledge 70 rests on flange ledges 35 of the channel section 20. A vertical rib 74 is provided on the outer wall surface 54 of the end cap 28 to keep the structure flat, help resist bowing and provide strength when the end cap 28 first comes out of the mold and is still hot and pliable.

The simple mechanical connection between the end caps 26, 28 and channel section 20 is usually sufficient, especially since a substantially water tight seal is created when the joint is encased in concrete. As is known in the art, the joints may be taped until the concrete is poured. Alternatively, the end caps 26, 28 may be fastened to the channel section 20 in any well known manner using glue, silicone or other adhesive or sealant. Generally, sealants are preferred when the drainage system is designed for corrosive liquids. In such applications, epoxy, one part urethanes or vinyl ester sealants are suitable.

Figure 5A:
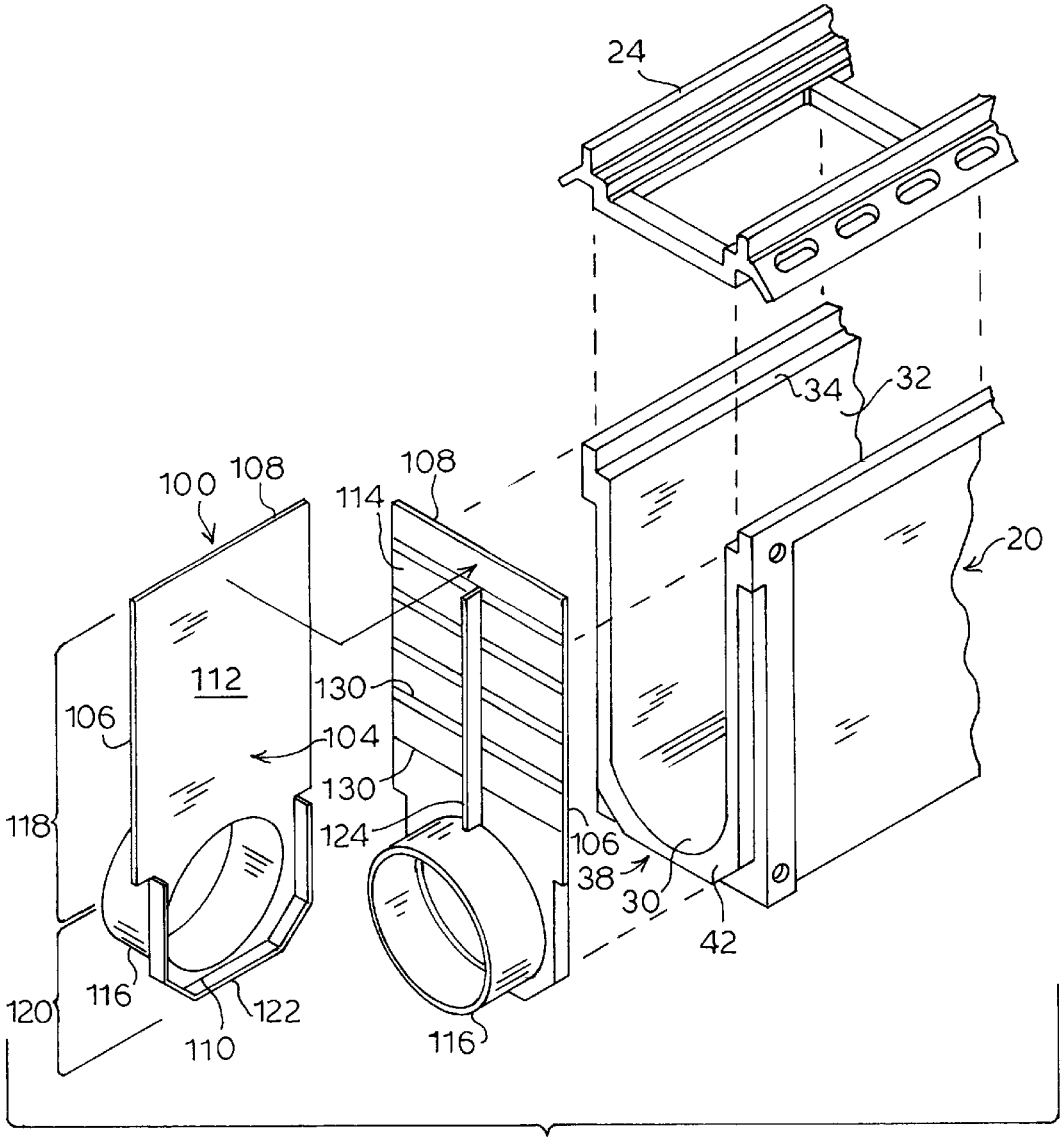
FIG. 5A is an exploded view of a portion of a male end of a channel section and a grate frame and showing an embodiment of a female drain end cap according to the present invention.
Figure 6B:
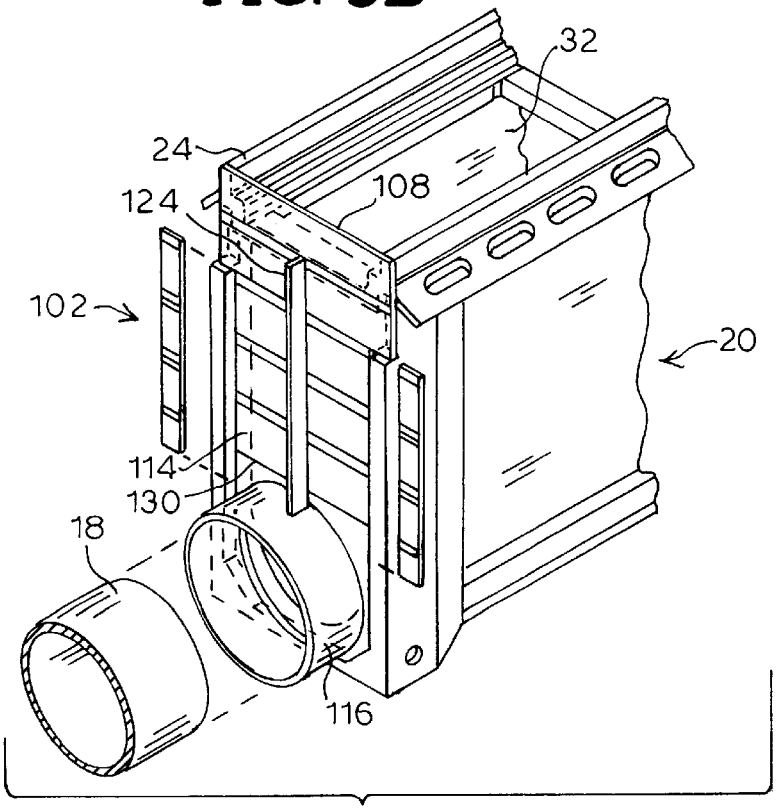
FIG. 6B is a perspective view of FIG. 6A showing the drain end cap in place on the end of the channel section.
Figure 6A:
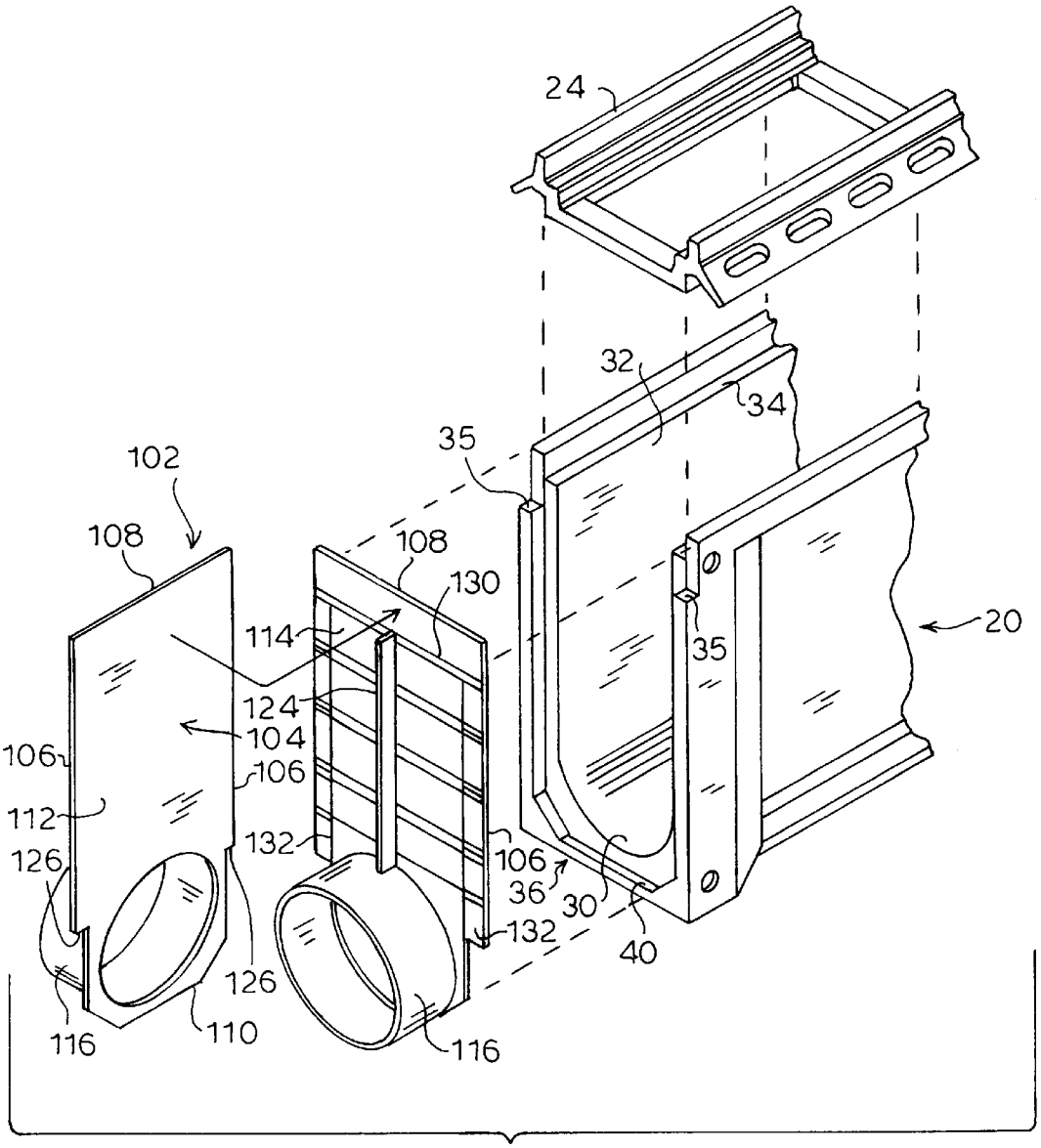
FIG. 6A is an exploded view of a portion of a female end of a channel section and a grate frame and showing an embodiment of a male drain end cap according to the present invention.

FIGS. 5A and 6A show another embodiment of the present invention comprising drain end caps 100, 102. As with the terminal end caps, the drain end caps 100, 102 comprise a wall 104 having side 106, top 108 and bottom 110 peripheral edge surfaces. The wall 104 has an inner surface 112 which faces the interior of channel section 20, and an opposed outer wall surface 114. A pipe extension 116, or "coupler," extends externally from the end cap wall 104. The drain end caps 100, 102 and pipe extension 116 are also preferably molded as a unitary body so as to form a substantially continuous component.

The pipe extension 116 defines an opening of a predetermined shape and size for receiving a pipe 18 such that the pipe and end cap 100, 102 are in fluid communication. The pipe 18 is typically a cylindrical shape having inner and outer circumferentially extending surfaces and is sized to support a predetermined maximum load or fluid flow rate. In a preferred embodiment, the inner diameter of the pipe extension 116 accommodates by friction fit the end of a commonly available, smooth-walled plastic pipe. The end of the pipe 18 seats against a small shoulder formed on the inner end of the opening of the pipe extension 116. Generally, the inner diameter of the opening defined by the pipe extension 116 is typically between about 2 inches and about 10 inches. Preferably, the pipe extension 116 is sized to receive 4" PVC pipe.

Of course, it is understood that the pipe extension 116 can be dimensioned at will without departing from the spirit and scope of the present invention since the height and width of the end cap will vary with the shape of the channel section which in turn affects the flow rate. In addition, although the pipe extension 116 and pipe 18 are depicted as being circular, the pipe extension 116 and pipe can have other shapes, such as oval, rectangular, trapezoidal or triangular shapes, without departing from the spirit and scope of the present invention. A removable diaphragm may also be provided across the inner end of the opening of the pipe extension 116 of the drain end caps 100, 102 so that the user may selectively use the drain end caps as terminal end caps.

If desired, means for securing the pipe 18 to the pipe extension 116 can also be employed to seal the joint coupling. Any number of appropriate methods are available, including adhesives or silicone sealants. For drainage systems including PVC pipes, the components can be solvent bonded or welded with an appropriate solvent, such as conventional ABS/PVC cement.

Figure 5B:
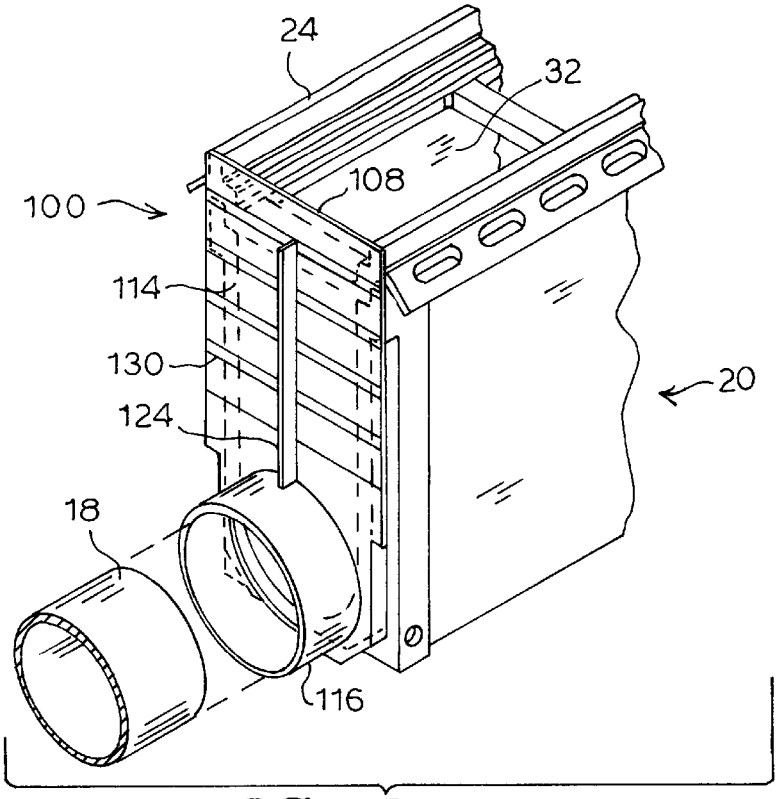
FIG. 5B is a perspective view of FIG. 5A showing the drain end cap in place on the end of the channel section.

As with the terminal end caps described above, the drain end caps 100, 102 are designed to fit the respective male end 38 and female end 36 of the channel section 20. As seen in FIGS. 5A and 5B, the female drain end cap 100 fits the male end 38 of the channel section 20. The female end cap 100 includes an upper portion 118 which is the full width of the channel section 20 and a narrower, lower portion 120 surrounding the pipe extension 116. The lower portion 120 includes a flange 122 extending substantially normally inwardly from the peripheral surfaces of the lower sides 106 and bottom wall 110 of the end cap 100. The female drain end cap also includes a vertical supporting rib 124. The flange 122 defines a pocket having the profile of the flange 42 at the male end 38 of the channel section 20 such that the channel section 20 and end cap 100 fit snugly together (FIG. 5B). When in position on the ends of the channel section 20, the female end cap 100 provides an outlet from the channel section 20 to the pipe 18.

The male drain end cap 102 is substantially the same shape as the female drain end cap 100. However, the inner wall surface 112 of the male drain end cap 102 is substantially flat and seats against the flange 40 at the female end 36 of the channel section 20. The male drain end cap 102 provides an inlet from the pipe 18 to the channel section 20.

The drain end caps 100, 102 thus allow liquids to flow freely into and out of the associated channel section 20 and connect the channel section 20 to the drainage system. The bottom inside surface of the pipe extension 116 is tangent with the inside bottom surface 30 of the channel section 20 to allow unobstructed movement of liquids.

In use, the channel sections are connected end-to-end until a trench drain of the desired length is complete. Then end caps are slipped on the open ends of the channel sections. Selected channel section ends receive terminal end caps, while others receive drain end caps for connection to pipes.

As described above, sloped channel sections get progressively deeper. Therefore, depending on the length of the run, different channel section depths will be presented for closing or draining. According to the present invention, each of the end caps described above is provided with horizontal transverse grooves 130. The grooves 130 define break-off points for creating end caps of different heights so as to match the depth of the corresponding channel section ends 36, 38. To accomplish the height adjustment, the grooves 130 are designed so that the end cap can be bent until it snaps off at the groove. Alternatively, appropriately placed blows of a hammer or cutting with a knife, cutter or saw through the groove will remove the unnecessary portion of the end cap. The terminal end caps 26, 28 are broken off from the bottom and the drain end caps 100, 102 are broken off from the top. The end cap can thus be adapted to fit the end of the channel section regardless of depth.

As seen in FIG. 6B, the male drain end cap 102 also includes vertical grooves 132. The vertical grooves 132 allow a portion of the side wall surfaces 106 of the end cap 102 to also be removed. The length of side wall 106 removed is selected so as to reposition a shoulder 126 formed on the side walls 106 at a predetermined point such that the shoulder 126 rests on the flange ledges 35 of the channel section 20 when the end cap 102 is in place.

All of the end caps of the present invention also include upper snap-off pieces for closing off the end of the grate frame 24 as shown in the drawings. If the grate frame 24 is not used, the piece is removed.

The grooves are preferably positioned so the resultant heights accommodate the different standard depths of commercially available channel sections. For example, the embodiment of the end caps shown and described herein have five possible heights. However, the end cap could be customized in the field by measuring and cutting for any intermediate channel depth.

The previously described versions of the present invention have many advantages, including providing a new, universal trench drain end cap. Each end cap is identically manufactured in terms of size, shape and configuration such that only one end cap is required for many applications. Rather than making several different sizes of end caps to accommodate channel sections of different depths, a single end cap is required for use with several sizes of conventional trench drains. For example, the four embodiments of the present invention described herein replace more than twenty conventional end caps. Moreover, manufacturing the molded, one-piece end caps is simple and economical and the number of end caps needed to be purchased, stocked and used is minimized.

The drain end cap of the present invention also reduces the possibility of damaging the component, thus facilitating transportation and storage of the drain end cap. Manufacture of the drain end cap does not require that the end cap be cast around a pipe extension or that a pipe stub be added to a terminal end cap in the field. Also, since the pipe extension is sized to directly receive the ends of standard pipe, no extra pieces or fittings are required for connection.

Although the present invention has been described in considerable detail in connection with particular embodiments thereof, it is understood, of course, that we do not intend to limit the invention to those embodiments since modifications may be made by those skilled in the art, particularly in light of the foregoing teachings. For example, the shape, size and manner of attaching the end caps to the channels sections may differ as long as the height of the end cap may be selected by the user. We intend to cover all alternatives, modifications and equivalents as may be included within the spirit and scope of the invention as defined by the appended claims. It is, therefore, contemplated by the appended claims to cover any such modifications as incorporate those features which constitute the essential features of these improvements within the true spirit and the scope of the invention.

We claim:

1. An end cap for a drainage system for water or other liquids, the drainage system including one or more trench drain channel sections, the end cap comprising a wall element having substantially the same profile as the cross-section of the end of the trench drain channel section, the wall element adapted to be coupled to the trench drain channel section to form a terminal end of the channel section, and having a transverse groove so that, when the end cap is separated at the groove, the height of the end cap corresponds to the depth of the channel section.

2. An end cap as recited in claim 1, wherein the end cap is a unitary molding.

3. An end cap as recited in claim 1, further comprising a plurality of grooves provided at spaced intervals along the vertical height of the wall element, the grooves corresponding to different possible depths of the channel section.

4. An end cap as recited in claim 1, further comprising a vertical rib for strengthening the wall element against lateral flexure.

5. An end cap as recited in claim 1, further comprising a conduit connector, the conduit connector comprising an outwardly extending flange projecting from the wall element of the end cap, the flange defining an aperture having a predetermined shape and size adapted to receive a conduit drain component of the drainage system.

6. An end cap as recited in claim 5, wherein the aperture of the connector has an inner diameter which is sized to snugly engage the conduit.

7. An end cap for a drainage system for water or other liquids, the drainage system including one or more trench drain channel sections, the end cap comprising:

a wall element having substantially the same profile as the cross-section of the end of the trench drain channel section, the wall element adapted to be coupled to the trench drain channel section to form an end of the channel section, a conduit coupler integrally molded with the wall element such that the wall element and coupler are substantially continuous, the conduit coupler extending outwardly from the wall element and defining an aperture having a predetermined shape and size for receiving a conduit such that the conduit and at least a portion of the coupler are in fluid communication, and the wall element having a transverse groove so that, when the end cap is separated at the groove, the height of the end cap corresponds to the depth of the channel section.

8. An end cap as recited in claim 7, wherein the end cap comprises a thermoplastic material.

9. An end cap as recited in claim 7, further comprising a plurality of grooves provided at spaced intervals along the vertical height of the wall element, the grooves corresponding to different possible depths of the channel section.

10. An end cap as recited in claim 7, further comprising a vertical rib for strengthening the end wall component against lateral flexure.

11. A drainage system for water or other liquids, the drainage system comprising:

a trench drain channel member having two terminal ends, an end cap substantially similar in profile to the cross-section of the channel member, the end cap having a plurality of spaced grooves along its length such that when the end cap is separated along one of the grooves, the resulting end cap has a height corresponding to the height of the end of the channel section, and a surface of the end cap adapted to be coupled to one of the terminal ends of the channel member for sealing the channel member.

12. A drainage system as recited in claim 11, wherein the end cap further comprises a pipe coupler flange integral with the end cap and approximate the bottom of the trench drain channel member, the flange adapted to receive a pipe drain.

13. A drainage system as recited in claim 11, wherein the pipe coupler flange defines an aperture of a predetermined size and shape which corresponds to the size and shape of the pipe, the pipe telescoped within the pipe coupler flange to facilitate the flow of fluids through the channel section.

14. The trench drain system as recited in claim 11, wherein the end cap is formed of injection molded plastic material.

15. The trench drain system as recited in claim 14, wherein the plastic material is a high density polyethylene.

16. A drainage system for draining surface fluids to a remote location, the drainage system comprising:

a plurality of open-topped, elongated trench drain members connected end-to-end, the members terminating in free ends and having a base portion and upstanding side walls integrally formed with the base, an end cap for sealing an open end of the trench drain members, an auxiliary drain pipe component, the end cap having an opening surrounded by an outwardly extending pipe connector flange adapted for sealably receiving the drain pipe, and means for permitting the end cap to be separated along its length to form an end cap of selected height when the end cap is separated, the height of the end caps matching the depth of the trench drain member whereby the end cap can be selectively cut to fit trench drain members of varying depths.

* * * * *